United States Patent [19]

Richart

[11] Patent Number: 4,660,647

[45] Date of Patent: Apr. 28, 1987

[54] FLUID CONTROL LINE SWITCHING METHODS AND APPARATUS

[75] Inventor: Jene A. Richart, Sugar Land, Tex.

[73] Assignee: Exxon Production Research Co., Houston, Tex.

[21] Appl. No.: 768,762

[22] Filed: Aug. 23, 1985

[51] Int. Cl.[4] ..... E21B 34/06; E21B 43/12

[52] U.S. Cl. ..... 166/386; 166/72; 166/115; 166/117.5; 166/242

[58] Field of Search ..... 166/117.5, 72, 380, 166/381, 386, 332, 242, 318, 115; 137/271

[56] References Cited

U.S. PATENT DOCUMENTS

| | | | |
|---|---|---|---|
| 3,786,863 | 1/1974 | Tausch | 166/72 |
| 4,119,146 | 10/1978 | Taylor | 166/72 |
| 4,249,599 | 2/1981 | Krause | 166/72 |
| 4,273,186 | 6/1981 | Pearce et al. | 166/72 |
| 4,407,363 | 10/1983 | Akkerman | 166/183 |
| 4,434,847 | 3/1984 | Vazquez et al. | 166/117.5 |
| 4,540,047 | 9/1985 | Akkerman | 166/188 |

*Primary Examiner*—James A. Leppink
*Assistant Examiner*—Hoang C. Dang
*Attorney, Agent, or Firm*—Karen T. Burleson

[57] ABSTRACT

Method and apparatus for altering the downhole flow path of control fluids or the like in oil and gas wells. A downhole side pocket mandrel in a tubing string has interconnected thereto a supply conduit from the surface and a plurality of receiving conduits. Each receiving conduit is connected to a control device. A plurality of different plug assemblies is provided, each for completing within the mandrel pocket when disposed therein a different hydraulic flow path between the supply conduit and one or more receiving conduits. The plug assemblies are insertable into and retrievable from the mandrel pocket by conventional running tools. Any desired control device may thereby be controlled at the surface with a single supply conduit by selection of the proper plug assembly. In a preferred embodiment, the plug assemblies are comprised of a plurality of subplugs which may be interconnected in differing orders to form the desired plug assembly.

9 Claims, 5 Drawing Figures

96
98
60
70
78
102
104
100
26
106
48
86
72
80
88
110
108
112
114
54
38
92
74
82
90
118
116
120
122
52
94
36
76
84
46

156
158
62
130
138
162
164
160
26
166
146
132
140
148
170
168
172
174
150
134
142
178
176
180
182
152
154
36
136
144
46

FLUID CONTROL LINE SWITCHING METHODS AND APPARATUS

FIELD OF THE INVENTION

This invention relates generally to methods and apparatus for varying the flow path of control fluids and pressures or the like in wells for the production of hydrocarbons. More particularly, this invention relates to methods and apparatus for routing control fluid from a supply conduit to one or more of a plurality of down hole fluid-receiving conduits.

BACKGROUND OF THE INVENTION

In the process of producing oil and/or gas wells, fluids from the surface often need to be injected into the wellbore through a supply conduit. Such fluids include, for example, chemicals to inhibit corrosion of the production tubing string in deleterious subsurface environments and hydrualic fluids to control safety valves.

The need for hydraulic fluids to control subsurface safety valves is especially pertinent to offshore wells. In emergencies brought about by bad weather conditions, for example, a danger may exist that the production string may be severed or severely damaged, resulting in uncontrolled flow of hydrocarbons from the well. To prevent such an occurrence, it is accepted practice to provide safety devices disposed along the tubing string and below the mud line for shutting off the flow of the well.

These safety devices generally comprise one or more valves hydraulically actuatable from the surface and thus in fluid communication with the aforementioned supply conduit. Upon sensing fluid pressure change in the conduit (brought about by a severing of the conduit or effected on the surface at a control panel by wellsite personnel), a closure member in the valve will shut in the well.

Many other instances arise wherein control of downhole apparatus, such as sliding sleeves known in the art, is desirably effected by means of a surface-actuated hydraulic control line extending into the wellbore or borehole. Moreover, several situations occur wherein the pathway of the fluid or pressure routed downhole in the supply conduit must be re-routed to a different location or elevation within the borehole.

For example, in the case of the aforementioned offshore wells, it is preferred practice to provide for redundancy in the form of multiple safety valves at various borehole elevations in the event one safety valve should fail. Thus, a conventional "tubing-retrievable" subsurface safety valve, well known in the art, is typically provided in the production string which is surface-controlled by the supply conduit.

In addition, a second back-up subsurface safety valve at a different borehole elevation may be further provided in series with the production string. This second valve will also desirably be hydraulically controllable from the surface in like manner. Such a valve may take the form of an "insert" safety valve, also conventionally known in the art. The use of such valves is generally described below.

One or more landing nipples are disposed along the tubing string at desired locations. An insert safety valve is then installed or "landed" in each nipple or retrieved therefrom, as desired, by means of an appropriate wire line tool, through-flow line technique, or the like, also well known in the art.

Each insert safety valve will be actuatable hydraulically from the surface by means of a hydraulic supply conduit. In order to selectively actuate each such safety valve, it would thus conventionally be necessary to provide a separate supply conduit aligned adjacent the tubing string and extending to the surface to provide control fluid pressure to each valve.

Thus, in the alternative, it would be highly desirable to have the downhole capacility to re-route from a single supply conduit, control or other fluids or hydraulic actuating pressure to any desired safety valve in the string. This would thereby obviate the need for inherently undesirable multiple supply conduits which, due to multiple fluid connections and the like, compound reliability problems such as leakage.

Finally, with regard to the aforementioned hydraulically sliding sleeves and the like, which may be simultaneously present in the string along with safety valves, it is also desirable to be able to selectively control each such device from one fluid control line traversing the formation.

Accordingly, methods and apparatus were highly sought after for the downhole re-routing of hydraulic actuating control fluids and pressures as well as chemicals or other fluids as desired. Moreover, such methods and apparatus were desired which were reliable and did not interfere with the normal operation and flow of the tubing string.

SUMMARY OF THE INVENTION

The methods and apparatus of the present invention are for the varying of fluid and pressure flow paths, such methods and apparatus being adapted particularly for use in oil and/or gas wells to route control fluid downhole from a supply conduit to one or more of a plurality of downhole fluid-receiving conduits, as desired.

The apparatus of the present invention generally comprises a side pocket mandrel adapted to receive, in fluid communication therewith, a supply conduit and a plurality of receiving conduits. The apparatus further comprises a plurality of plug assemblies each disposable within the pocket and adapted to effect fluid communication between different respective ones of the receiving conduits and the supply conduit, as desired.

The method of the present invention generally comprises preselecting a given one or more of the plurality of receiving conduits to be connected in fluid communication with the supply conduit as desired, preselecting one of the plurality of plug assemblies in functional relation to the aforesaid desired combination of supply and receiving conduits, and thence disposing said plug assembly within the side pocket mandrel to effect said fluid communication.

More particularly, in a preferred embodiment of the present invention, the mandrel has an inflow port adapted to matingly receive in fluid-tight connection a proximal end connector of a supply conduit extending from the surface. The mandrel further has a plurality of outflow ports spaced axially along the mandrel, each adapted to matingly receive in fluid-tight connection a proximal end connector of a respective one of a plurality of receiving conduits. Each receiving conduit may be interconnected to a respective fluid controlled downhole device as desired, such as a subsurface safety valve.

Each plug assembly has an inflow port, at least one outflow port, and a bore extending therethrough interconnecting the inflow and outflow ports internally of the plug assembly.

Preferably, a plurality of seals are coaxially disposed about each plug assembly such that at least one such seal is spaced in the axial direction on either side of and adjacent to each respective plug assembly's inflow port and outflow port(s). Each seal will preferably effect fluid-tight sealing engagement between its respective plug assembly and the inner wall of the mandrel when the plug assembly is disposed therein.

Each plug assembly corresponds to a different set of ports in the mandrel, each set being comprised of the inflow port and one or more different axially-spaced outflow ports. The axial distance separating the inflow and outflow ports of a given plug assembly are thus functionally related to the axial distance separating the corresponding set of inflow and outflow ports in the mandrel.

In this manner, when the particular plug assembly is coaxially and vertically disposed within the mandrel with the input ports of the plug assembly and mandrel adjacent each other, the pair of sealing members associated with the inflow port of the plug assembly will be vertically above and below the inflow ports of both the plug assembly and mandrel. Accordingly, fluid communication will be established between the two inflow ports.

In like manner, the pair(s) of sealing members associated with the outflow port(s) of the plug assembly will also be vertically above and below the outflow port(s) of both the plug assembly and mandrel, establishing fluid communication between the outflow ports of the plug assembly and mandrel.

Thus, when a given plug assembly is disposed in the mandrel and vertically aligned so that corresponding inflow and outflow ports will be adjacent one another, fluid communication will be established from the supply conduit, through the mandrel inflow port, through the plug assembly inflow port, and along the bore therethrough. Fluid communication will further be established from the plug assembly bore, through the outflow port(s) thereof, and through the outflow port(s) of the mandrel, and into the receiving conduit(s) associated with the outflow port(s).

Accordingly, by selecting the appropriate plug assembly having inflow and outflow port spacings and sealing member spacings corresponding to a desired mandrel inflow-outflow port(s) pair or set, fluid communication may be established from the inflow of the mandrel through the preselected plug assembly to any desired mandrel outflow port.

In operation, the mandrel is disposed serially along a tubing production string. The distal ends of receiving conduits are interconnected to any desired respective fluid-actuated devices, such as safety valves also disposed along the tubing string.

When it is desired to deliver fluid control to a given device to activate it or the like, a plug assembly is preselected with proper internal porting which, when disposed within the mandrel, will make the appropriate fluid interconnection through the plug assembly and between the inflow port of the mandrel and the outflow port of the mandrel which is interconnected to the particular device.

DETAILED DESCRIPTION OF THE PREFERRED EMBODIMENT

Figures 1, 2:
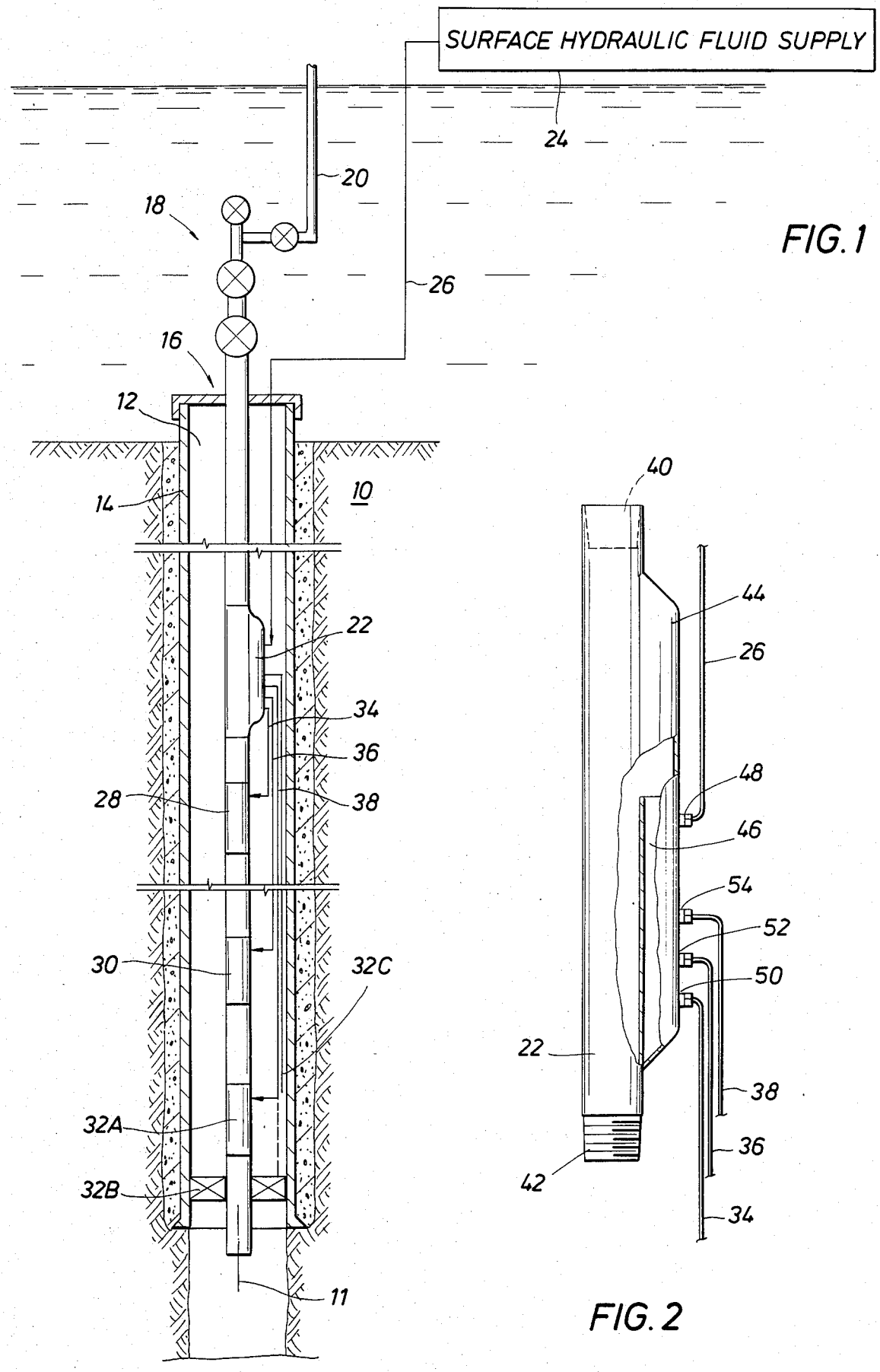
FIG. 1 is a pictorial view, partly schematic, depicting the downhole fluid routing system of the present invention.
FIG. 2 is a pictorial view, partly in section, depicting one embodiment of the side pocket switch illustrated in FIG. 1 with the plug assembly portion removed.

FIG. 1 is a pictorial view generally depicting a typical downhole fluid routing system of the present invention. A subsurface earth formation 10, which in the embodiment depicted may be a subsea formation, is traversed by a well borehole 12 which may be cased with casing 14 and cemented in the conventional manner.

Disposed in coaxial alignment with the borehole 12 along a central axis 11 is a production tubing string 16. Above the subsea formation surface, a "Christmas tree" 18 is interconnected for well-known purposes to the tubing string 16, followed by the balance of the tubing 20 which is routed to an appropriate vessel for storing or processing the produced hydrocarbons.

Referring now to a particular portion of the string 16, a side pocket control line switch or modified side pocket mandrel 22 of the present invention is provided in serial and coaxial alignment with the string 16 along axis 11.

In one embodiment of the invention, a surface hydraulic supply 24 is in fluid communication with mandrel 22 by means of a hydraulic fluid control line which will hereinafter be referred to as a control or supply conduit 26. The purpose of supply 24 is to provide to mandrel 22 a source of hydraulic fluid pressure controllable at the surface by appropriate control devices at a panel or the like.

Also in serial and coaxial alignment with the string 16 along axis 11 there will be seen representative examples of a plurality of hydraulically actuated devices such as an insert safety valve contained in the landing nipple 28, and a tubing-retrievable safety valve 30 hereinbefore discussed in greater detail. A representative conventional insert safety valve, landing nipple, and tubing-retrievable safety valve suitably adapted for use with the present invention may be seen depicted on pages 660, 666, and 642, respectively, of the 1984–85 Composite Catalog, published by Gulf Publishing Company, P. O. Box 2608, Houston, Tex. It will be recalled that the purpose of such safety devices is to shut off flow of hydrocarbons through the bore of the string 16 in response to a fluid control signal carried by supply conduit 26. Such may be desired, for example, if the string 16 becomes damaged or severed.

It is specifically contemplated as being within the scope of the present invention to control any number and type of fluid control activated downhole devices. The invention accordingly admits of numerous other such devices which may be beneficially controlled in the manner of the present invention, and the invention is thus not intended to be so limited to any particular control devices herein disclosed. Therefore, for purposes of generality, any other fluid controlled device 32A may be included in the string 16, such as a fluid-actuated tubing hanger or the like.

Moreover, in some oil and/or gas operations, other devices or procedures may be employed which although not a part of a tubing string 16 may nevertheless be adapted to benefit from the present invention. Accordingly, in FIG. 1, a fluid-control activated packer 32B and a chemical injection point 32C may be seen depicted therein for use in conjunction with the methods and apparatus of this invention to be described hereinafter in greater detail.

Still referring to FIG. 1, a plurality of control lines hereinafter referred to as fluid receiving conduits 34, 36, and 38, interconnect, respectively, to safety valves 28, 30, and either another device 32A requiring periodic hydraulic control and a part of the string 16, or packer 32B or to injection point 32C. The dotted line portion of receiving conduit 38 is intended to indicate that it may be connected alternatively to device 32A, packer 32B, or injection point 32C. It is unlikely that the same side pocket mandrel would be used to inject fluids as well as to control safety valves, inasmuch as these fluids are different and would generally not be used in the same system. However, the embodiment depicted in FIG. 1 is for purposes of generality to indicate that the switching methods and apparatus of the present invention disclosed herein may be employed with a variety of downhole devices and for a variety of purposes.

Before explaining the more detail the construction of the mandrel 22 with reference to FIG. 2, a general discussion of the overall operation of the system illustrated in FIG. 1 will be helpful.

It will be recalled that it is frequently desirable to control a plurality of various downhole apparatus and procedures from the surface by means of hydraulic fluid flow or pressure. Examples previously given include the operation from the surface of hydraulically activated flow control valves, back-up valves, tubing hangers, the latching and unlatching of packers, and so on.

Moreover, these operations and procedures may have to be effected at differing borehole elevations, an example being the desirability of chemical injection at a plurality of borehole locations 32C, which may differ in elevation, or the control of valves 28 and 30 which are at differing locations along the borehole.

One approach might be to route separate hydraulic control lines such as supply conduit 26 along the borehole from the surface and directly to each such device. However, as aforementioned, this technique is fraught with many difficulties, not the least of which is that with many individual added supply conduits, problems of conduit leaking are compounded greatly.

FIG. 1 shows that the receiving conduits 34, 36, and 38 provide fluid connection, respectively, between devices 28, 30, and 32A, 32B, or 32C, and the mandrel 22. However, supply conduit 26 also provides fluid communication between hydraulic supply 24 and mandrel 22.

The present invention provides a plurality of plug assemblies, to be hereinafter described, which effect fluid interconnection between supply conduit 26 and any one or more of the plurality of receiving conduits 34, 36, and 38, as desired, with each such different plug assembly providing a different hydraulic interconnection.

Thus, by preselecting a desired hydraulic inter-connection between the supply conduit 26 and one or more of the plurality of receiving conduits 34, 36, or 38 (depending on the devices interconnected to the receiving conduits and desirability of which are to be operated), any such interconnection may be made. This may be conventionally effected by first retrieving to the surface through string 16 an existing plug assembly, if any, disposed within the mandrel 22, by means of a conventional running tool. The appropriate proper substitute plug assembly is thence inserted into the mandrel 22 from the surface, again by means of a running tool.

Referring now to FIG. 2, the particular construction of one embodiment of the mandrel 22 of the present invention may be seen depicted in more detail. First, the mandrel will be provided with upper and lower threads 40 and 42 for purposes of being threadedly mated into sections of the tubing string 16 which are threaded in like manner.

The mandrel 22 will further include a side pocket 44 portion which extends in a direction generally transversely off the axis 11. The pocket 44 is depicted in cut-away section in FIG. 2 so as to illustrate that it preferably contains an inner pocket receiver 46 portion having a generally cylindrical or elongate tubular shape for purposes to be hereinafter described with reference to FIGS. 3–5.

Still referring to FIG. 2, the supply conduit 26 and receiving conduits 34, 36, and 38 may be seen fluidly interconnected to this pocket receiver 46 portion of side pocket 44 by means of any conventional hydraulic connectors 48, 50, 52, and 54, respectively. These connectors, in turn, define a corresponding inflow port and three outflow ports as indicated from the cut-away portion of the wall of pocket receiver 46.

It will be noted that in this manner, fluid or pressure within conduits 26 and 34, 36, and/or 38, will be in fluid communication through these respective ports to the bore defined by the wall of pocket receiver 46.

A plug assembly positioned inside the pocket receiver 46 effects fluid interconnection between the inflow port defined by connector 48 and any desired one or ones of the outflow ports defined by connectors 50, 52, and 54, to accomplish the fluid switching objective of the present invention. Such an assembly will now be described, by example, with reference to FIGS. 3, 4, and 5.

Figure 3:
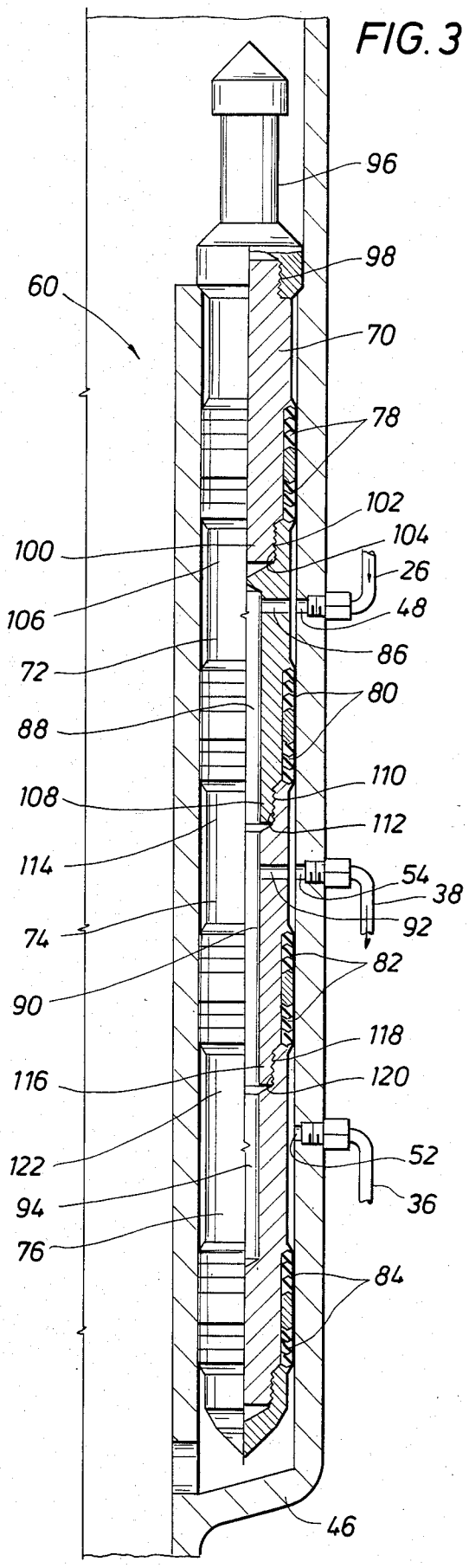
FIG. 3 is a pictorial view, partly in section, depicting an embodiment of the side pocket swtich illustrated in FIG. 1 and including one form of plug assembly.

In FIG. 3, there is depicted an illustrative plug assembly 60 which, when properly installed in the annulus defined by pocket receiver 46, as shown, will hydraulically interconnect supply conduit 26 to receiving conduit 38. In this manner, downhole device 32A may be controlled by hydraulic supply 24 from the surface.

A detailed description of the construction and operation of plug assembly 60 will first be given. This will then be followed by discussion of an alternate plug assembly construction in the manner of the present invention as illustrated by plug assembly 62 in FIG. 4. This plug assembly 62 effects hydraulic interconnection between supply conduit 26 and receiving conduit 36 to control safety valve 30 from the surface through supply conduit 26.

Finally, yet a third example of alternate construction of plug assemblies will be given with respect to plug assembly 64 depicted in FIG. 5. This plug assembly will hydraulically interconnect supply conduit 26 and receiving conduit 34 for controlling an insert safety valve in landing nipple 28 from the surface.

For simplicity, none of these examples include a plug assembly interconnecting with more than one receiving conduit. However, plug assemblies interconnecting with more than one receiving conduit are within the scope of this invention. Such plug assmblies would work similarly to the simpler ones described below except that the porting and sealing and annular bores of these more complex plug assemblies would allow flow to more than one outflow port for interconnection with more than one receiving conduit extending to more than one device. More than one device could also be controlled within the scope of this invention by having one receiving conduit go to multiple devices or by having one receiving conduit branch into multiple conduits extending to multiple devices after interconnection with the plug assembly.

Thus, it may be appreciated that by proper construction of an appropriate plug assembly with correct porting and sealing, any desired interconnection between a plurality of conduits in fluid connection to mandrel 22 may be made internally of the mandrel by means of the plug assembly contained therein.

Referring now back to FIG. 3, in more detail, plug assembly 60 will be seen to be preferably comprised of first, second, third and fourth subplugs 70, 72, 74, and 76. Plug assemblies such as assembly 60, 62, and 64 in one embodiment are preferably fashioned of these subplugs so as to provide different porting as desired. This is accomplished simply by altering the order in which the subplugs are interconnected. However, it is to be understood that plug assemblies 60, 62, and 64 may alternatively be of an integral or unitary construction, if desired, and construction is therefore not intended to be limited to plug assembly construction comprised only of subplugs.

Still referring to FIG. 3, each subplug 70, 72, 74 and 76 will preferably carry a respective pair of elastomeric packers 78, 80, 82, and 84, respectively.

The second subplug 72 will include an inflow port 86 extending generally transverse to axis 11 and will further include a bore 88 extending longitudinally or coaxially along axis 11 when installed in the mandrel 22.

Similarly, the third subplug 74 will have a bore 90 extending therethrough and an outflow port 92. Due to the sealing by packers 78, 80, and 82 above and below ports 86 and 92, fluid flow or pressure will thus be communicated between supply conduit 26 and receiving conduit 38 by transmission in plug 60 through the passageway formed by ports 86, 92 and bores 88 and 90.

A bore 94 is provided in the fourth subplug 76. However, inasmuch as no porting to this bore is provided, it functionally has no effect.

The first suplug 70 will preferably have a fishing neck 96 with threaded portion 98 for facilitating retrieval of the plug assembly from an installation into the pocket receiver 46 with conventional running tools employing well-known techniques. The subplug will as well include a lock (not shown) for locking the plug assembly 60 in place within the mandrel 22. Subplug 70 will further have a stub 100 with threads 102 to be matingly and threadedly received by a box 106 having internal threads 104.

In like manner, subplugs 72 and 74 will have stubs 108 and 116 with respective threads 110 and 118 for being threadedly inserted into boxes 114 and 122, respectively, which, also in like manner, have internal threads 112 and 120.

Figure 4:
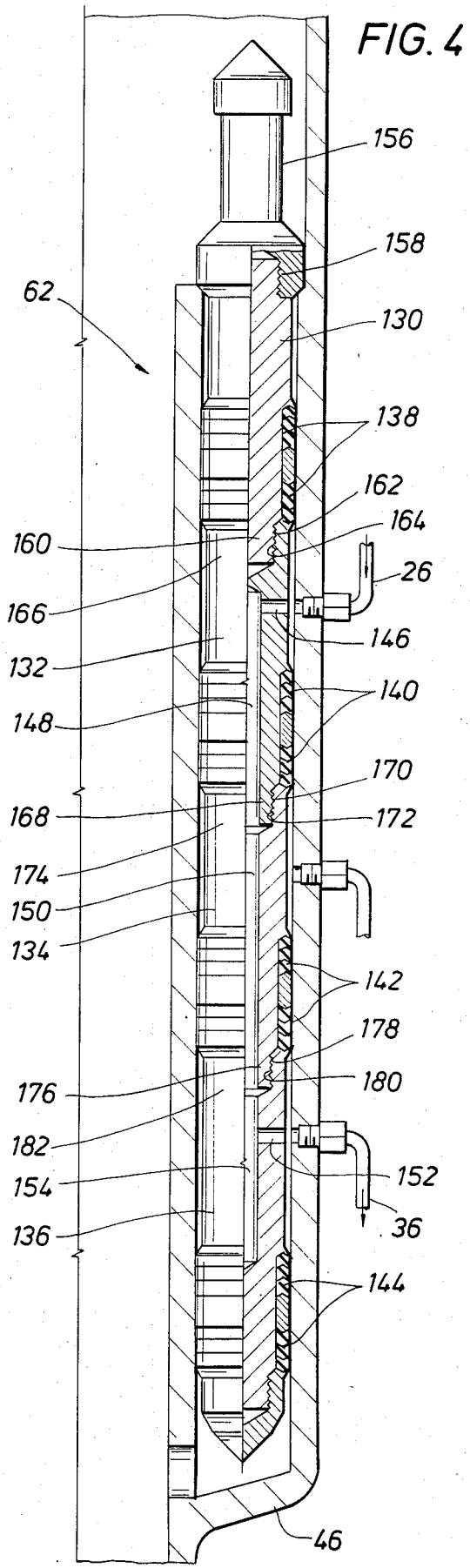
FIG. 4 is a pictorial view, partly in section, depicting another embodiment of the side pocket switch illustrated in FIG. 1 and including another form of plug assembly.

Referring now to FIG. 4, an alternate embodiment of a plug assembly will be detailed, specifically the plug assembly 62 depicted therein. This plug assembly is again comprised of first, second, third and fourth subplugs 130, 132, 134, and 136 which are again threaded together to form plug assembly 62. Also similar to plug assembly 60, each subplug is provided with a respective packer 138, 140, 142, and 144 coaxially disposed about the respective subplug.

Again, second subplug 132 has an inflow port 146 and a longitudinal bore 148. However, comparison of subplug 74 of plug assembly 60 with subplug 134 of plug assembly 62 shows that the outflow port 92 of subplug 74 has been omitted in corresponding subplug 134. Instead, subplug 134 simply has a continuous bore 150 therethrough. However, a closer look at the fourth subplug 136 reveals that this subplug carries the outflow port 152 as well as a central bore 154.

Accordingly, with respect to plug assembly 62, ports 146 and 152, as interconnected by internal bores 148, 150, and 154 in subplugs 132, 134, and 136, respectively, provide fluid and pressure communication between supply conduit 26 and receiving conduit 36 when plug assembly 62 is installed in the pocket receiver 46 in mandrel 22 due to the sealing of packets 138, 140, 142, and 144.

Still referring to FIG. 4, plug assembly 62 will be seen to be of similar construction to plug assembly 60 (depicted in FIG. 3) regarding the interconnection of subplugs. Specifically, a fishing neck 156 with threads 158 and the aforementioned lock are again provided on first subplug 130.

Moreover, subplugs 130, 132, and 134 include respective stubs 160, 168, and 176 with corresponding threads 162, 170, and 178. Subplugs 132, 134, and 136 also have respective boxes 166, 174, and 182 with threads 164, 172, and 180 for threadedly receiving the next uppermost subplug to form plug assembly 62.

Figure 5:
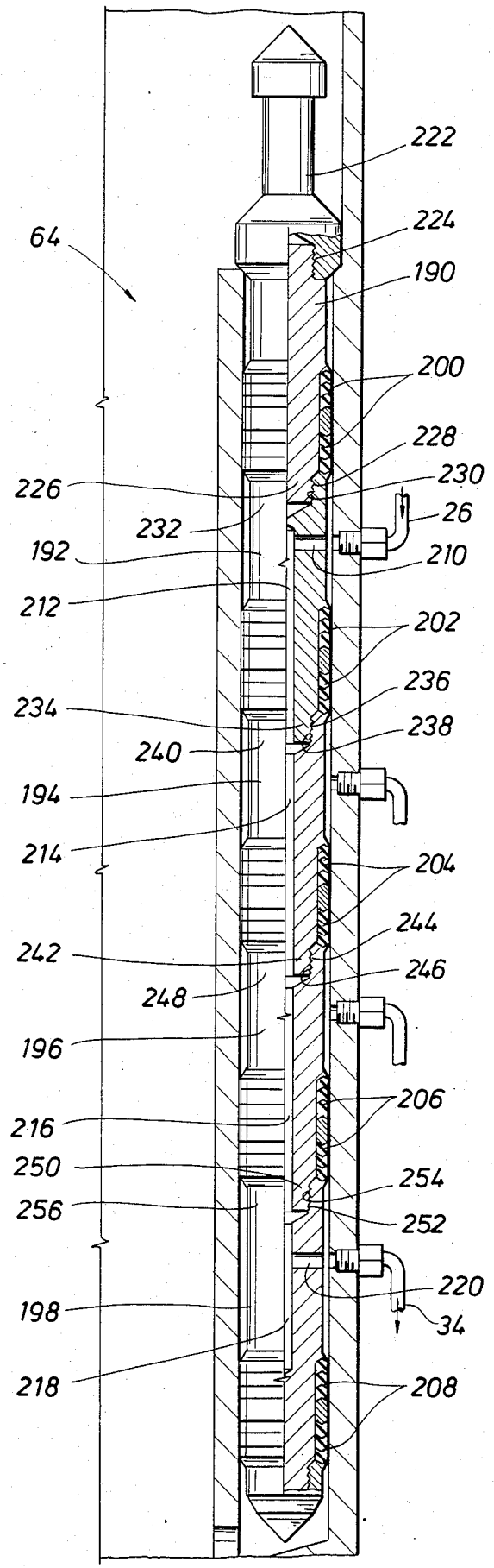
FIG. 5 is a pictorial view, partly in section, depicting another embodiment of the side pocket switch illustrated in FIG. 1 and including yet another form of plug assembly.

Finally, with reference to FIG. 5, still a third plug assembly 64 is therein depicted. This plug assembly may be fashioned of first, second, third, fourth, and fifth subplugs 190, 192, 194, 196, and 198, again with corresponding packers 200, 202, 204, 206, and 208 being coaxially disposed thereabouts.

Again, stubs 226, 234, 242, and 250 with corresponding threads 228, 236, 244, and 252 are provided for being receiving by corresponding boxes 232, 240, 248, and 256 having internal respective threads 230, 238, 246, and 254.

In the case of plug assembly 64, an inflow port 210 is provided in subplug 192 and an outflow port 220 in subplug 198. A bore 212, 214, 216, and 218, in subplugs 192, 194, 196, and 198, respectively, provides fluid and pressure communication between supply conduit 26, and receiving conduit 34 to operate insert safety valve in landing nipple 28 or other downhole devices as desired. This passageway is established by provision of a fluid and pressure path from ports 210 and 220 through the bore in the plug assembly 64 defined by the bores 212, 214, 216 and 218.

The foregoing discloses but one embodiment of the invention. However, several factors must be noted in order to appreciate the true generality of the invention and its adaptability to a widely varying range of applications, forms, and associated problems.

First, whereas there has been disclosed herein a particular application in which various hydraulically actuated devices have been controlled, the invention is not intended to be limited to use within a particular device to be controlled. In fact, as discussed previously, the advantages of the invention may even be enjoyed without employing control devices at all. One example of this is the deployment of the invention to direct chemical injection fluids into differing elevations within the borehole by simply routing receiving conduits to these levels. Upon deploying an appropriate plug assembly, chemicals may thence be routed through the supply conduit to the desired receiving conduit. Thus, in a broad sense, the invention disclosed herein is a general method and apparatus for effecting fluid-tight interconnection together of any number of downhole fluid or pressure-conveying conduits in a variety of combinations. Moreover, the invention is thus neither limited in application only to situations wherein the conduits carry flowing fluids as opposed to merely conveying pressure, but rather contemplates both uses as well as the intentional communication of pressures or fluids in an upward as well as a downward direction.

As to particular embodiments of the invention herein depicted, a specific mandrel known as a side pocket mandrel has been shown to be used with one or more plug assemblies which may take various forms such as those illustrated herein.

However, in a broad sense, the mandrel serves merely to provide a bore to which are connected a plurality of conduits to be fluid-interconnected in a desired manner. Thus, when the term mandrel is used, the invention is not intended to be limited in scope to employment with side pocket mandrels only. Rather, the invention contemplates use of any downhole member which might provide a bore defined by a wall capable of mating with conduits and further capable of sealing engagement with a plug apparatus insertable into and releasable therefrom.

As to the plug assemblies, once again particular forms and configurations have been depicted and described herein. However, in a broad functional sense the plug assemblies should have two basic features. First, such a plug assembly must be capable of being inserted into and retrievable from the mandrel as, for example, with a conventional running tool. Secondly, the particular plug assembly must include an internal passageway therethrough for bridging or splicing internally of the bore between the ports of any two or more conduits as desired which have been mounted into the wall forming a bore and thus are in communication therewith. Of course, in the embodiments depicted herein the means for fluid connecting this internal passageway to the various ports of the conduits is by means of sealing members so as to force fluid and pessure from a conduit through the plug assembly internal passageway and out to a different conduit or conduits.

Accordingly, it will be appreciated that it is a matter of choice as to the number of conduits to be switched and interconnected at a given time, and accordingly the invention admits of any number of plug assemblies which must be fashioned so as to provide the necessary internal passageways to effect the required conduit interconnections internally of the as desired. Moreover, as a matter of convenience, the plug assemblies of the present invention have been depicted herein in subplug form wherein a desired plug assembly may be formed by combining subplug components. This is primarily for purposes of flexibility in enabling a user to fashion a number of different plug assemblies from a small number of building block subplugs. However, if desired, these plug assemblies may be fashioned in an integral or unified body form.

It is therefore apparent that the present invention is one well adapted to obtain all of the advantages and features hereinabove set forth, together with other advantages which will become obvious and apparent from the description of the apparatus itself. It will be understood that certain combinations and subcombinations are of utility and may be employed without reference to other features and subcombinations. Moreover, the foregoing disclosure and description of the invention is only illustrative and explanatory thereof, and the invention admits of various changes in the size, shape and material composition of its components, as well as in the details of the illustrated construction, without departing from the scope and spirit thereof.

What is claimed is:

1. A system for use in controlling the flow of downhole fluids in oil and/or gas wells, comprising:

first and second fluid pressure actuated control devices, each said device being disposed in series in a tubing string in said well and having a respective inflow port;

a side pocket mandrel disposed in said tubing string and including an inflow port and first and second outflow ports;

a surface fluid pressure supply;

a supply conduit interconnecting said inflow port of said mandrel and said surface fluid pressure supply;

a first receiving conduit interconnecting said first outflow port of said mandrel and said inflow port of said first control device;

a second receiving conduit interconnecting said second outflow port of said mandrel and said inflow port of said second control device;

a first plug assembly insertable into and retrievable from said mandrel for establishing fluid communication between said supply conduit and said first receiving conduit; and a second plug assembly insertable into and retrievable from said mandrel for establishing fluid communication between said supply conduit and said second receiving conduit.

2. A system for use in controlling the flow of downhole fluids in a tubing string in oil and/or gas wells, comprising:

first and second flow control safety valves having respective first and second inflow ports and actuated in response to fluid pressure, each said safety valve being disposed in series in said tubing string;

a side pocket mandrel disposed in said tubing string and including an inflow port and first and second outflow ports;

a surface fluid pressure supply;

a supply conduit interconnecting said inflow port of said mandrel and said surface fluid pressure supply;

a first receiving conduit interconnecting said first outflow port of said mandrel and said inflow port of said first safety valve;

a second receiving conduit interconnecting said second outflow port of said mandrel and said inflow port of said second safety valve; and a plug assembly insertable into and retrievable from said mandrel for establishing fluid communication between said supply conduit and said first and second receiving conduits, wherein said plug assembly comprises a first and a second internal passageway respectively interconnecting said inflow port of said mandrel to said first and second outflow ports of said mandrel when said plug assembly is disposed within said mandrel.

3. The system of claim 1, wherein at least one of said plug assemblies is further comprised of a plurality of subplugs interconnected in coaxial alignment.

4. The system of claim 3, wherein a portion of said plug assembly comprises substantially indentical subplugs.

5. A method for altering the downhole fluid path of control fluids in oil and/or gas wells, comprising:

disposing a side pocket mandrel in series in a tubing string, said mandrel having a bore therein;

disposing a supply source of fluid at the wellsite surface;

interconnecting a supply conduit between said supply source and said mandrel to establish fluid communication between said fluid source and said bore;

interconnecting a plurality of receiving conduits to said mandrel each of which terminates at a respective end wherein control fluid or pressure is desired, to establish fluid communication between said respective conduit ends and said bore;

disposing a first plug assembly in said mandrel bore having a first passageway therethrough for establishing one of said fluid paths internal of said bore between said supply conduit and at least one of said plurality of receiving conduits;

retrieving said plug assembly from said bore when said altering of said fluid path is desired; and disposing a second plug assembly in said mandrel bore having a second passageway therethrough for establishing a second of said fluid paths internal of said bore between said supply conduit and at least one different receiving conduit of said plurality of receiving conduits.

6. The method of claim 5, further comprising:

providing a plurality of subplugs for forming said second plug assembly, each said subplug being interconnectable to others of said plurality of subplugs in coaxial alignment and in different orders to establish different respective internal passageways through said second plug assembly as a function of said orders;

preselecting one of said passageways required to establish said second fluid path internal of said bore;

preselecting a corresponding plurality of said subplugs which will form said second fluid path when in coaxial alignment in one of said orders; and interconnecting said plurality of subplugs which will form said second fluid path in said one of said orders to form said second plug assembly.

7. The method of claim 5, wherein said step of retrieving said first plug assembly comprises removing said first plug assembly from said bore in said mandrel and moving said first plug assembly within and along said tubing string to the surface of said well.

8. The method of claim 7, wherein said step of disposing said second plug assembly in said mandrel bore includes moving said second plug assembly within and along said tubing string from said surface of said well and into said bore in sealingly mating engagement therewith.

9. The system of claim 1, wherein each plug assemblies each comprise a plug having an internal passageway interconnecting said inflow port of said mandrel to a preselected one of said outflow ports of said mandrel when said plug assembly is disposed within said mandrel.

* * * * *